US007672624B2

(12) United States Patent
Dawson et al.

(10) Patent No.: US 7,672,624 B2
(45) Date of Patent: Mar. 2, 2010

(54) BEARING AND LOCATING MEMBER FOR A TONER CARTRIDGE FOR USE WITH AN IMAGE FORMING DEVICE

(75) Inventors: Jedediah Taylor Dawson, Lexington, KY (US); Matthew Thomas Kerley, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 604 days.

(21) Appl. No.: 11/612,662

(22) Filed: Dec. 19, 2006

(65) Prior Publication Data

US 2008/0145110 A1 Jun. 19, 2008

(51) Int. Cl.
*G03G 15/08* (2006.01)

(52) U.S. Cl. ..... 399/263; 399/262; 399/120

(58) Field of Classification Search ..... 399/262, 399/263, 120
See application file for complete search history.

(56) References Cited

U.S. PATENT DOCUMENTS 5,260,750 A * 11/1993 Ishida et al. ..... 399/262
5,294,968 A * 3/1994 Ueda et al. ..... 399/256
6,587,660 B2 * 7/2003 Ueno et al. ..... 399/252
6,823,160 B2 * 11/2004 Okabe ..... 399/222
2002/0064401 A1 * 5/2002 Ashikari ..... 399/258
2006/0171744 A1 * 8/2006 Ikeda et al. ..... 399/262
2007/0077101 A1 * 4/2007 Tamura et al. ..... 399/262

* cited by examiner

*Primary Examiner*—David M Gray
*Assistant Examiner*—Rodney Bonnette
(74) *Attorney, Agent, or Firm*—David Kalish; John Victor Pezdek

(57) ABSTRACT

The present application is directed to toner cartridges with a bearing plate to locate and provide a bearing surface to one or more rotational members. The bearing plate may be positioned on an outer wall of a body of a toner cartridge. The bearing plate may include apertures to receive shafts of a series of rotational members. The bearing plate may locate the shafts relative to the body such that each is operatively connected together through a gear train. Bearing plate may also provide a bearing surface for the rotating shafts.

19 Claims, 7 Drawing Sheets

BEARING AND LOCATING MEMBER FOR A TONER CARTRIDGE FOR USE WITH AN IMAGE FORMING DEVICE

BACKGROUND

The present application is directed to toner cartridges and, more specifically, to cartridges with a bearing and locating member.

Image forming devices use toner for producing images on a media sheet. The toner may be housed within a cartridge that is removable from the image forming device. Removal and installation of the cartridges may occur during initial start-up of the device, when the toner has been depleted from the cartridge, and miscellaneous other occurrences.

The cartridges may include various elements that rotate about a shaft. The elements may include agitating members to agitate and move the toner, an auger for directing the toner towards an outlet, and drive members for powering the various elements. Each of these elements may be driven by a gear and therefore location of these elements relative to each other is critical to their functionality. The cartridge should include some manner of accurately positioning the shafts.

The cartridge should further be constructed to prevent toner leakage from the interior reservoir. Toner leaks may result in print defects, and toner inadvertently contacting the user or the user workstation. The cartridge should also be constructed to work properly in forming quality images, yet not be constructed in a manner that greatly increases the overall cost of the cartridge. Cost may be a major factor in the purchasing decisions of consumers when selecting a cartridge.

SUMMARY

The present application is directed to toner cartridges with a bearing plate to locate and provide a bearing surface to one or more rotational members. The bearing plate may be positioned on an outer wall of a body of a toner cartridge. The bearing plate may include apertures to receive shafts of a series of rotational members. The bearing plate may locate the shafts relative to the body such that each is operatively connected together through a gear train. Bearing plate may also provide a bearing surface for the rotating shafts.

DETAILED DESCRIPTION

Figure 1:
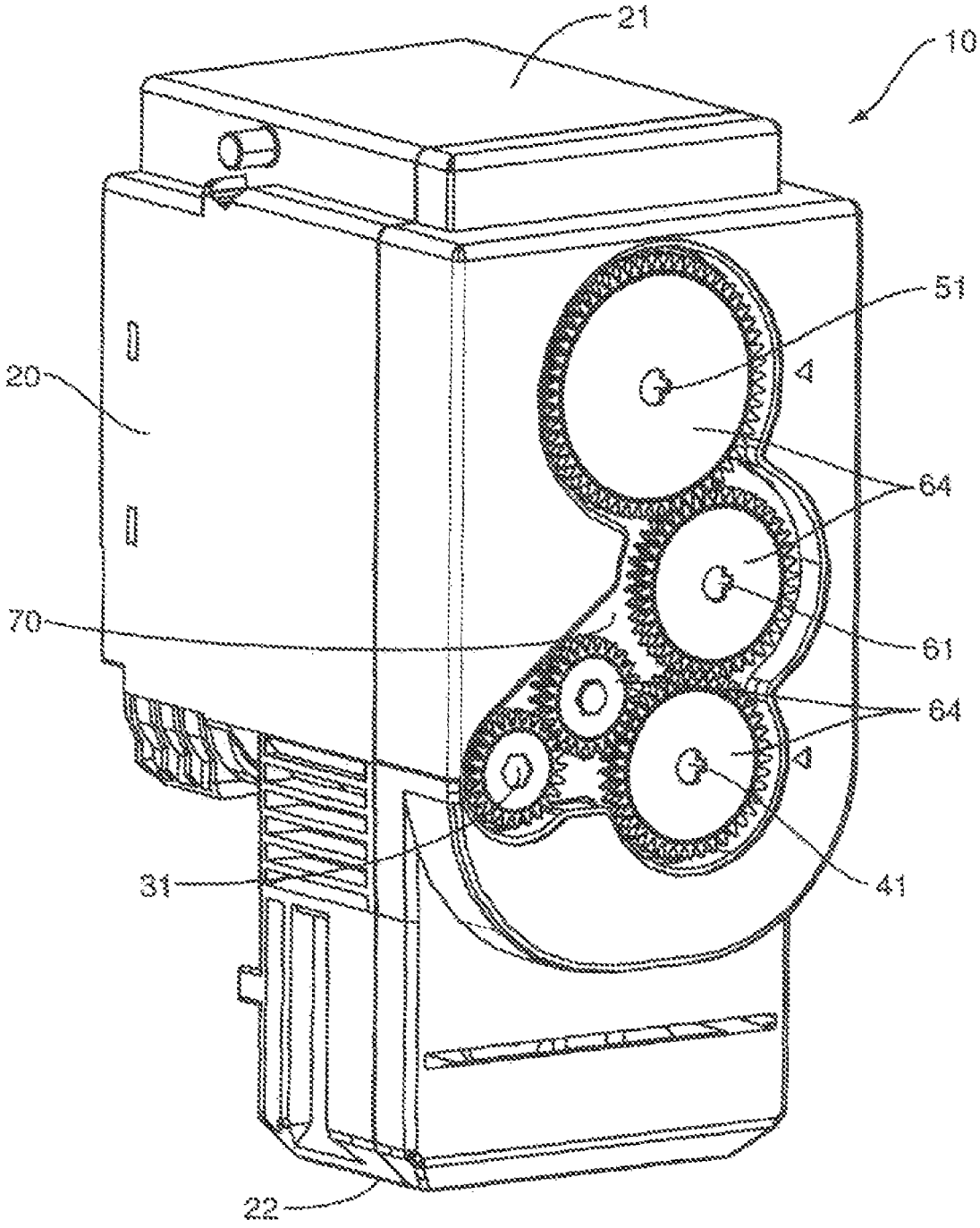
FIG. 1 is a perspective view of a cartridge body, bearing plate, and gears according to one embodiment.

The present application is directed to toner cartridges with a bearing plate to provide location and bearings for one or more rotational shafts. FIG. 1 illustrates one embodiment of a cartridge 10 including a bearing plate 70 positioned on a body 20. The bearing plate 70 is positioned on an outer wall of the body 20 and includes apertures to receive shafts 31, 41, 51, 61 of a series of rotational members. The bearing plate 70 locates the shafts 31, 41, 51, 61 relative to the body 20 such that each is operatively connected together. Bearing plate 70 also provides a bearing surface for the rotating shafts 31, 41, 51, 61.

Figure 2:
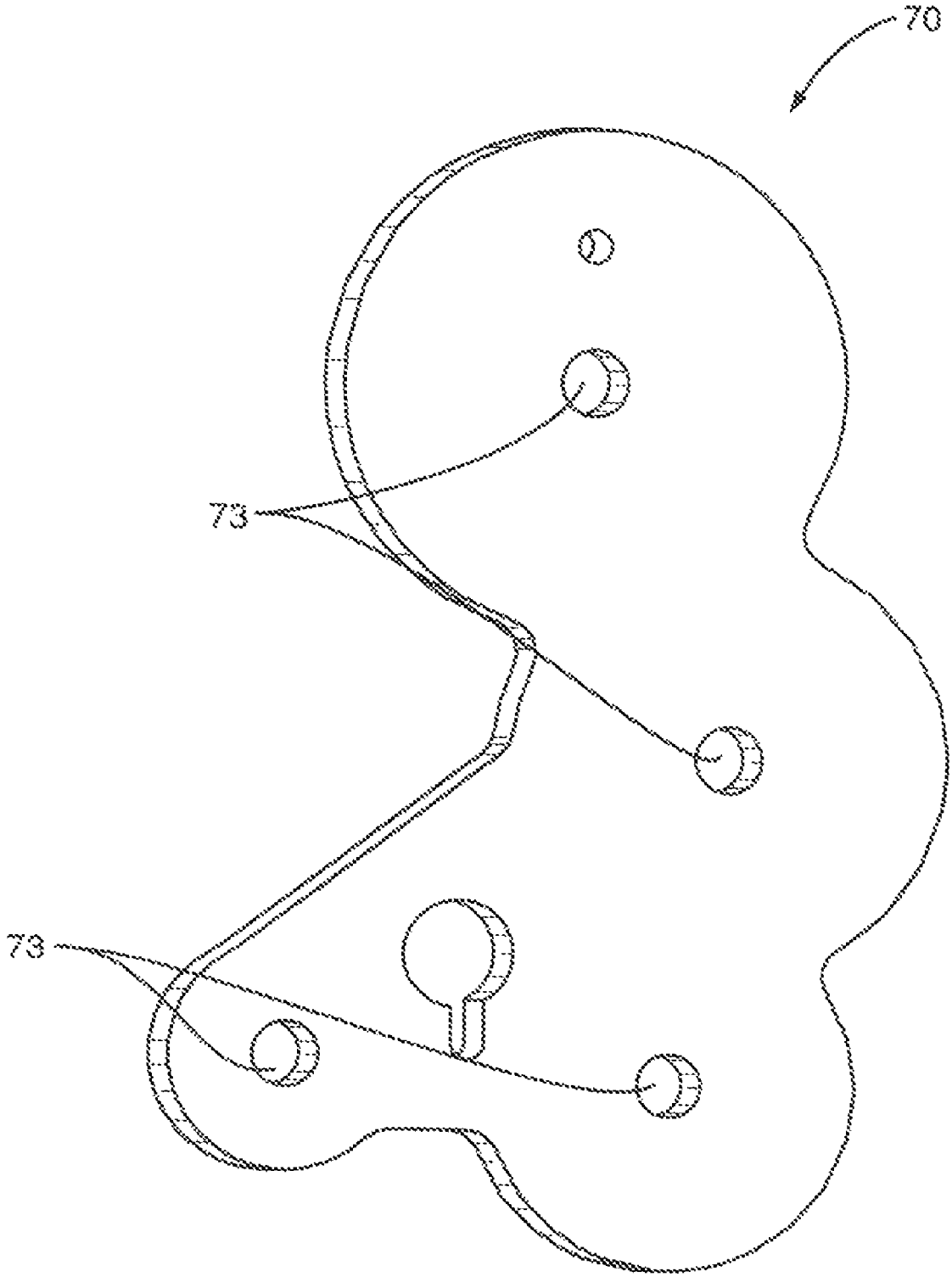
FIG. 2 is a perspective view of a bearing plate according to one embodiment.

Bearing plate 70 is attached to the body 20 to locate and provide a bearing surface for the shafts 31, 41, 51, 61. FIG. 2 illustrates one embodiment of the bearing plate 70. Apertures 72 are positioned to receive the shafts 31, 41, 51, 61. Each aperture 73 may be substantially the same size, or may be different. The shape of the bearing plate 70 may vary depending upon the positioned of the shafts and the shape of the attached gears 64 (see FIG. 6). Bearing plate 70 contacts the shafts 31, 41, 51, 61 as they extend outward from the reservoir and is constructed of a material that is wear-resistant. Examples of materials for the bearing plate 70 include but are not limited to plastics such as polycarbonate and metals. The thickness of the bearing plate 70 may vary depending upon the material. In one embodiment, the bearing plate 70 includes a thickness of at least about 0.05 mm. In a specific embodiment, the bearing plate is constructed from polycarbonate with a thickness of about 0.75 mm. Bearing plate 70 may further be constructed of a material that is different than the body 20, and may be thinner than walls of the body 20.

Figure 3:
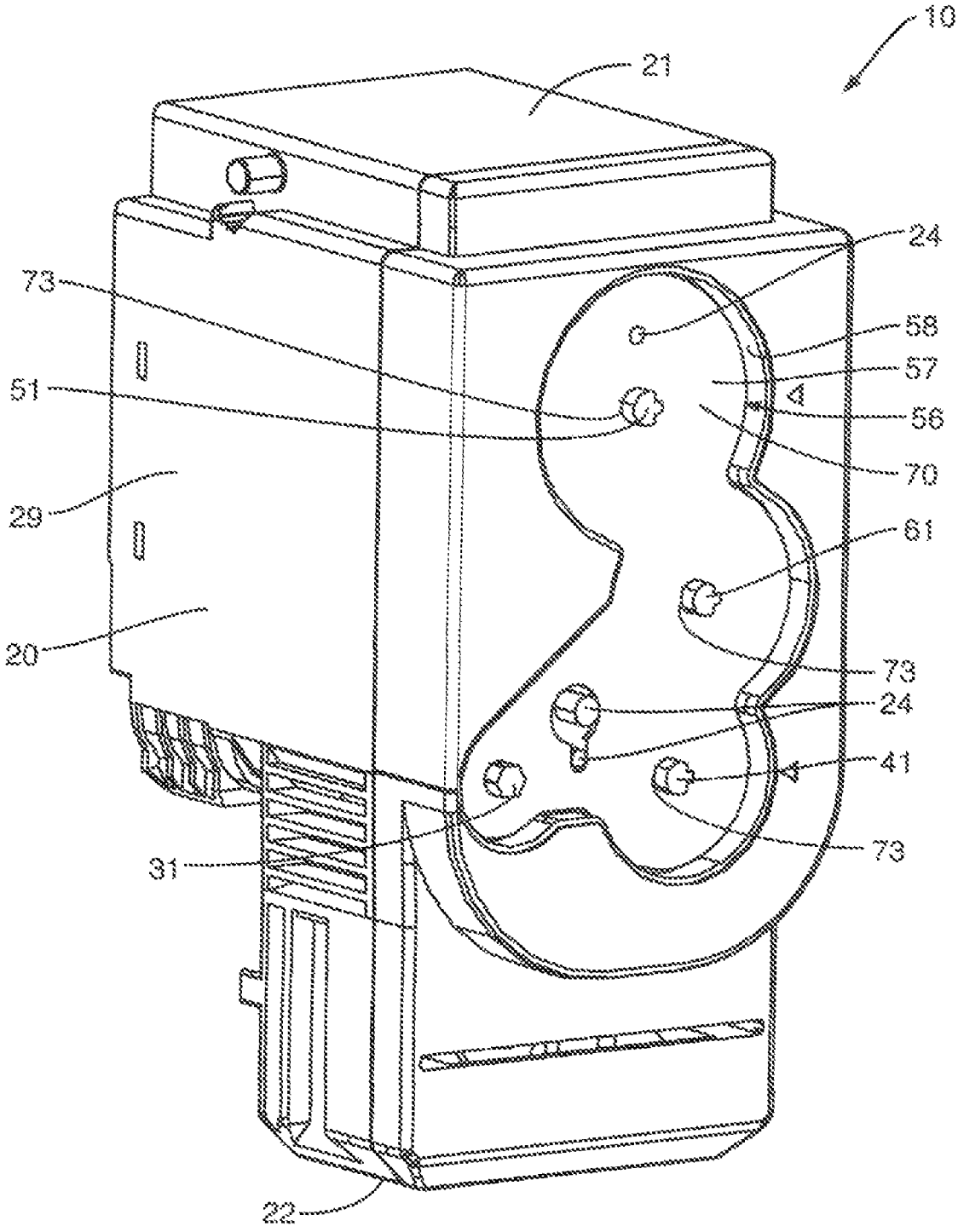
FIG. 3 is a perspective view of a cartridge body with a bearing plate according to one embodiment.
Figure 4:
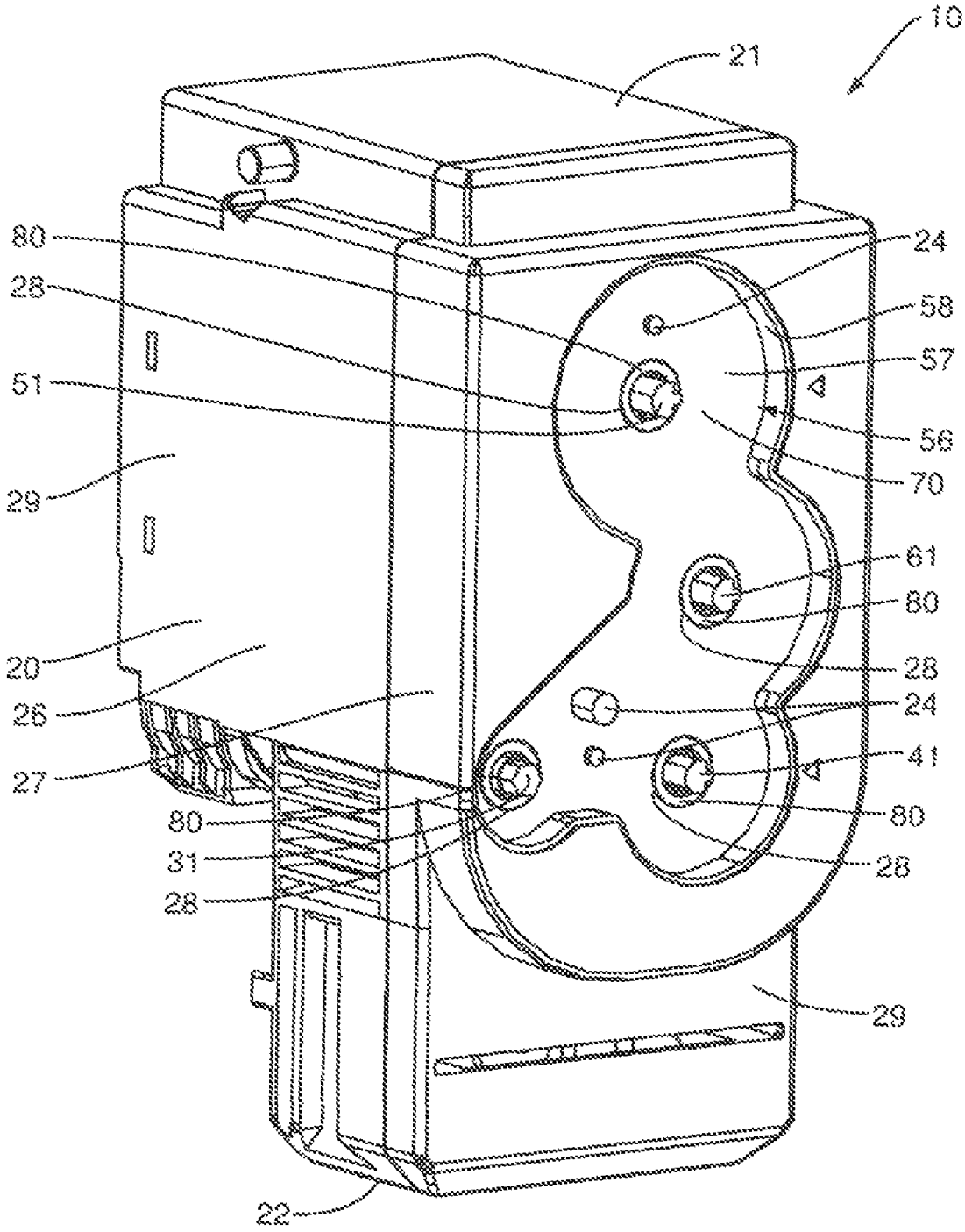
FIG. 4 is a perspective view of a cartridge body without a bearing plate according to one embodiment.

Cartridge 10 further includes a body 20 that forms an enclosed interior reservoir 91 for holding toner. As illustrated in FIGS. 3 and 4, body 20 includes an upper side 21, lower side 22, and side walls 29. FIG. 3 includes the bearing plate 70 attached to the body 20, and FIG. 4 illustrates the body 20 without the bearing plate 70. An indentation 56 may be formed within the body 20 to receive the bearing plate 70. Indentation 56 includes a bottom side 57 and side walls 58. In embodiment of FIG. 1, the indentation 56 is positioned on a side wall 29 between the upper and lower sides 21, 22. In one embodiments as illustrated in FIG. 3, the shape of the indentation 56 is substantially the same as the shape of the bearing plate 70. The common shapes may assist in maintaining the position of the bearing plate 70 relative to the body 20.

One of more extensions 24 may extend outward from the bottom side 57 of the indentation 56. As illustrated in FIG. 3, the extensions 24 fit within apertures 73 in the bearing plate 70 to further attach the bearing plate 70 to the body 20, and maintain the position of the bearing plate 70 relative to the body 20. Apertures 28 as illustrated in FIG. 4 extend through the body 20 in the bottom side 57 of the indentation 56 to receive the shafts 31, 41, 51, 61.

Figure 5:
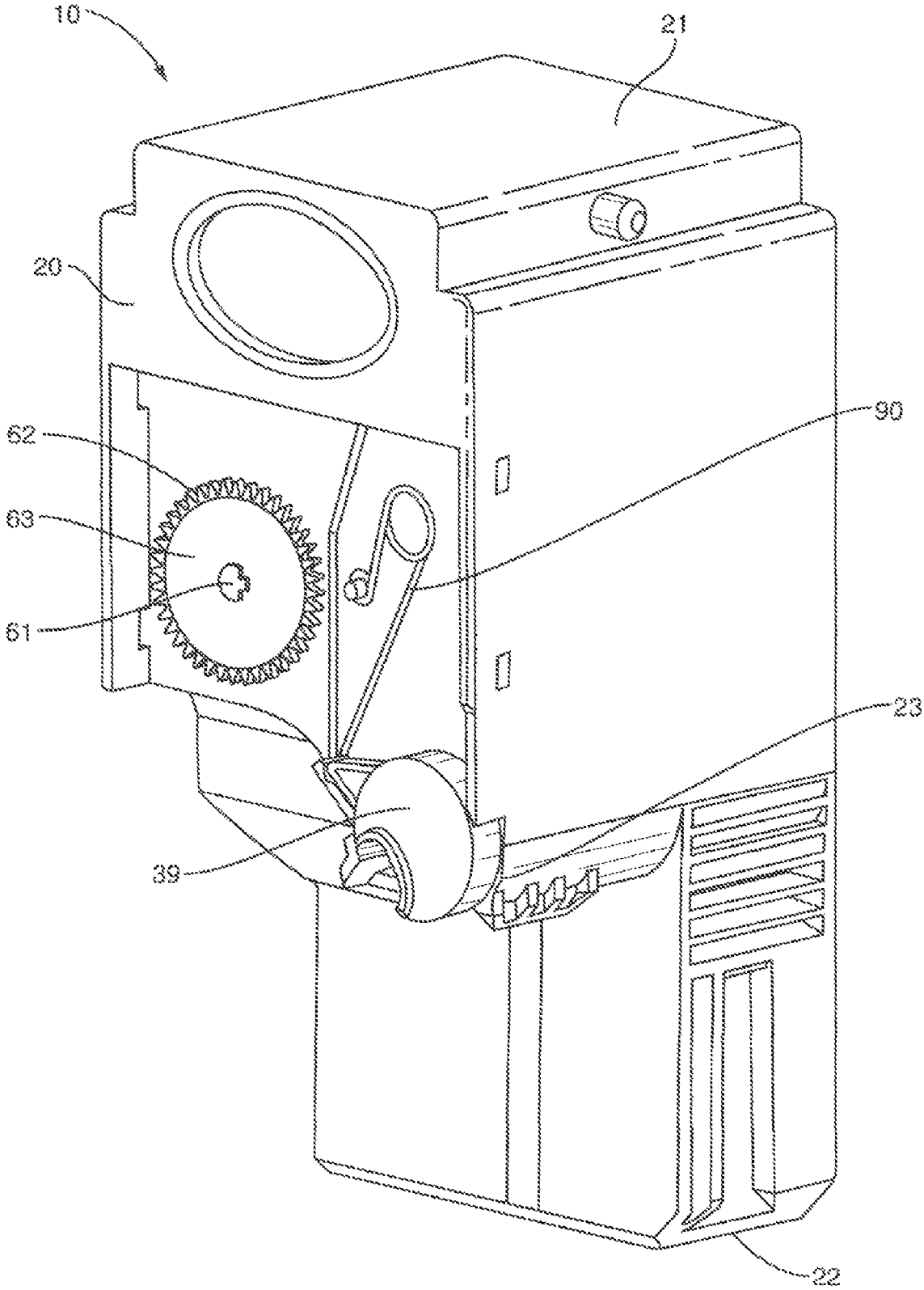
FIG. 5 is a perspective view of a second side of a cartridge body according to one embodiment.

Body 20 further includes an outlet 23 as illustrated in FIG. 5 to move the toner from the reservoir 91 and into the image forming device 100. A shutter 39 may be positioned at the outlet 23 to control the movement of the toner. A biasing member 90 may be located to move the shutter 39 between an open orientation to move toner from the reservoir 91 and a closed orientation to prevent toner from moving from the reservoir 91. In one embodiment, the outlet 23 is positioned on an opposing side of the body 20 from the gears 64.

Figure 6:
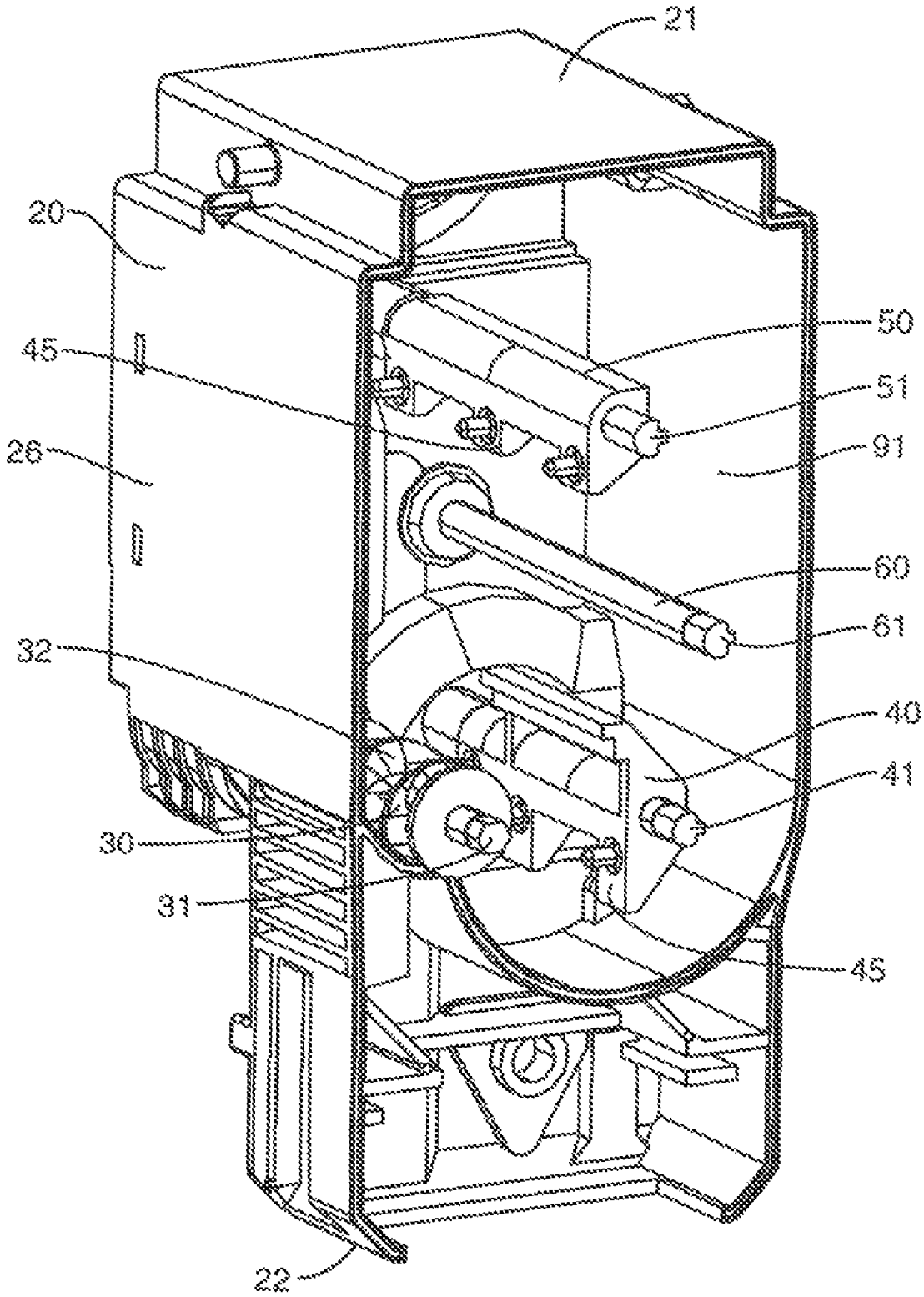
FIG. 6 is a perspective view of an interior of a cartridge body including a plurality of shafts according to one embodiment.

In one embodiment, body 20 is formed in a single piece. In another embodiment, body 20 includes a first section 26 and a second section 27. FIG. 6 illustrates the first section 26 with the second section 27 removed. The separate sections 26, 27 may facilitate manufacturing and assembly of the cartridge 10. The sections 26, 27 are attached together, such as through ultrasonic welding, to form a complete body 20 as illustrated in FIG. 4.

Cartridge 10 further includes a number of rotating members such as agitating members 40, 50, augers 30, and input members 60 as illustrated in FIG. 6. The agitating members 40, 50 each include a shaft 41, 51 with a first section positioned within the reservoir 91, and an end that extends outward from the body 20. Paddles 45 may be positioned on the first section within the reservoir 91 to agitate and move the toner during rotation. Note that a majority of the paddles 45 are removed in FIG. 6 for purposes of clarity.

The auger 30 is attached to the body 20 for moving the toner towards the outlet 23. Auger 30 includes a shaft 31 with an outwardly extending helical blade 32. Rotation of the shaft 31 causes tone to be moved by the blade 32 and directed towards the outlet 23. In one embodiment, shutter 39 within the outlet 23 includes a hollow sleeve that is sized to receive the auger 30.

The input member 60 includes a shaft 61 that extends through the reservoir 91. A first end of the shaft 61 extends outward beyond a first side of the body 20 as illustrated in FIG. 6. As illustrated in FIG. 5, a second end of the shaft 61 extends through a second side of the body 20 and connects to a drive gear 63.

As illustrated in FIG. 4, each of the shafts 31, 41, 51, 61 extend outward through apertures 28 in the first side of the body 20. Seals 80 may be positioned within the apertures 28 to prevent toner leakage from the reservoir 91. Seals 80 prevent toner leakage while still allowing for rotation of the shafts 31, 41, 51, 61. As illustrated in FIG. 3, shafts 31, 41, 51, 61 further extend through apertures 73 in the bearing plate 70. The bearing plate 70 positions the shafts 31, 41, 51, 61 within each of the body apertures 28 to prevent contact and wear from occurring along the edges of the body apertures 28.

Gears 64 are attached to the ends of the shafts 31, 41, 51, 61 that extend outward from the body 20 and the bearing plate 70 as illustrated in FIG. 1. Each gear 64 includes a central aperture to receive one of the shafts 31, 41, 51, 61, and teeth extending around the periphery. The bearing plate 70 locates the shafts 31, 41, 51, 61 such that the gears 64 are operatively connected together to form a continuous gear train. One or more gears 64 may also be attached to extensions 24 that extend outward from the body 20. These gears 64 on the extensions 24 are necessary to connect with the gears 64 on the shafts 31, 41, 51, 61 to complete the gear train.

In one embodiment, gear 64 is attached to the first end of the input shaft 61 (FIG. 1) and the drive gear 63 is attached to the second end of the input shaft 61 (FIG. 5). When the cartridge 10 is mounted within the image forming device 100, the drive gear teeth 62 engage with a drive mechanism in the device 100 to rotate the drive gear 63 and input shaft 61. This rotation causes the gears 64 in the gear train to rotate and thus rotate the various connected elements located within the reservoir 91. The rotation causes the toner to be agitated and moved through the outlet 23 as a step in the image forming process.

Figure 7:
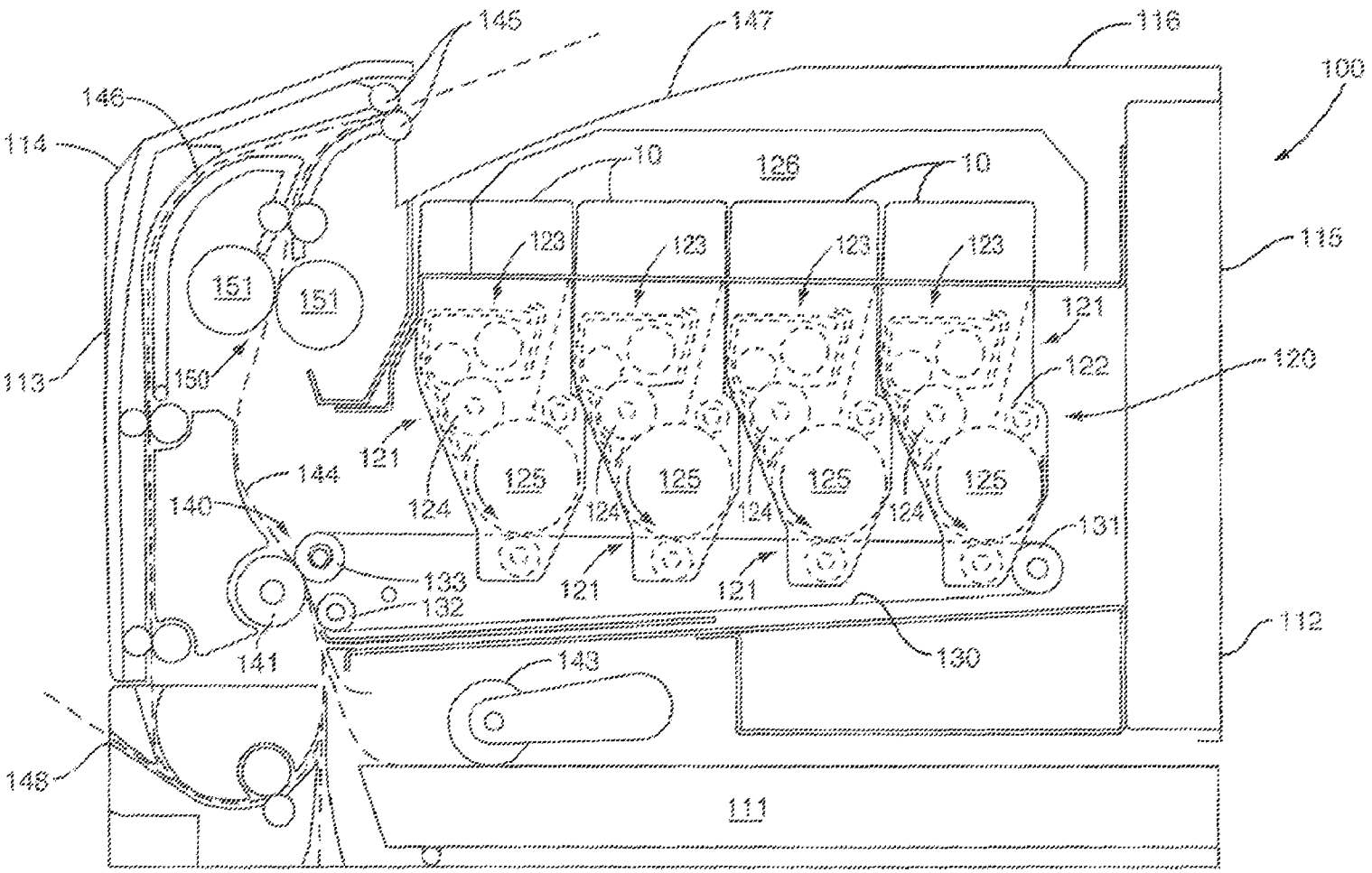
FIG. 7 is a side schematic view of an image forming device according to one embodiment.

FIG. 7 illustrates one embodiment of an image forming device 100. The device 100 includes a media input tray 111 positioned in a lower section of a body 112. The tray 111 is sized to contain a stack of media sheets that will receive color and/or monochrome images. The media input tray 111 is preferably removable for refilling. A control panel 114 may be located on the front 113 of the body 112. Using the control panel 114, the user is able to enter commands and generally control the operation of the image-forming device 100. For example, the user may enter commands to switch modes (e.g., color mode, monochrome mode), view the number of images printed, take the device 100 on/off line to perform periodic maintenance, and the like.

A first toner transfer area 120 includes one or more imaging units 121 that are aligned horizontally extending from the front 113 to a back 115 of the body 112. Each imaging unit 121 includes a charging roll 122, a developer 123 that includes various paddles and roller for stirring and moving toner and a developer roll 124, and a rotating photoconductive (PC) drum 125. The charging roll 122 forms a nip with the PC drum 125, and charges the surface of the PC drum 25 to a specified voltage such as −1000 volts, for example. A laser beam from a printhead 126 contacts the surface of the PC drum 125 and discharges those areas it contacts to form a latent image. In one embodiment, areas on the PC drum 125 illuminated by the laser beam are discharges to approximately −300 volts. The developer roll 124, which also forms a nip with the PC drum 125, then transfers toner from the cartridge 10 containing a supply of toner to the PC drum 125, to form a toner image. The toner is attracted to the areas of the PC drum 125 surface discharged by the laser beam from the printhead 126.

The cartridges 10 may be operatively connected to each of the developers 123 in toner transfer relationship, when the toner cartridges 10 are inserted into the imaging forming device 100. The toner cartridges 10 may be mounted and removed from the device 100 independently from the imaging units 121. In one embodiment, he toner cartridges 10 each contain one of black, magenta, cyan, or yellow toner. Each of toner cartridges 10 may be substantially the same, or one or more of the toner cartridges 10 may hold different toner capacities. In one specific embodiment, the black toner cartridge 10 has a higher capacity than the others. The toner cartridges 10 may mount from a top 116 of the device 100, in a generally vertical direction, and may detach during removal with the imaging units 121 remaining within the device 100.

An intermediate transfer mechanism (ITM) 130 is disposed adjacent to each of the imaging units 121. In this embodiments, the ITM 130 is formed as an endless belt trained about support roller 131, tension roller 132 and back-up roller 133. During image forming operations, the ITM 130 moves past the imaging units 121 in a clockwise direction as viewed in FIG. 7. One or more of the PC drums 125 apply toner images in their respective colors in the ITM 130. In one embodiment, a positive voltage field attracts the toner image from the PC drums 125 to the surface of the moving ITM 130.

The ITM 130 rotates and collects the one or more toner images from the imaging units 121 and then conveys the toner images to a media sheet at a second transfer area. The second transfer area includes a second transfer nip 140 formed between the back-up roller 133 and the second transfer roller 141.

a media path 144 extends through the device 100 for moving the media sheets through the imaging process. Media sheets are initially stored in the input tray 111 or introduced into the body 112 through a manual feed 148. The sheets in the input tray 111 are picked by a pick mechanism 143 and moved into the media path 144. In this embodiment, the pick mechanism 143 includes a roller positioned at the end of a pivoting arm. The roller rotates to move the media sheets from input tray 111 towards the second transfer area. In one embodiment, the pick mechanism 143 is positioned in proximity (i.e., less than a length of a media sheet) to the second transfer area with the pick mechanism 143 moving the media sheets directly from the input tray 111 into the second transfer nip 140. For sheets entering through the manual feed 148, one or ore rollers are positioned to move the sheet into the second transfer nip 140.

The media sheet receives the toner image from the ITM 130 as it moves through the second transfer nip 140. The media sheets with toner images are then moved along the media path 144 and into a fuser area 150. Fuser area 150 includes fusing rollers or belts 151 that form a nip to adhere the toner image to the media sheet. The fused media sheets then pass through exit rollers 145 that are located downstream from the fuser area 150. Exit rollers 145 may be rotated in either forward or reverse directions. In a forward direction, the exit rollers 145 move the media sheet from the media path 144 to an output area 147. In a reverse direction, the exit rollers 145 move the media sheet into a duplex path 146 for image formation on a second side of the media sheet.

The embodiment disclosed above include the bearing plate 70 positioned within an indentation 56 in the body 20. In another embodiment, the body 20 does not include an indentation 56 and the bearing plate 70 is attached to an outer wall.

In one embodiment as illustrated in FIG. 1, the gears 64 are exposed on the exterior of the cartridge body 20. In another embodiment, a cover may extend over a portion or entirety of the gears 64. Likewise, a cover may extend over the entirety or a portion of the drive gear 63 and biasing member 90 on the second side of the cartridge body 20.

Terms such as "first", "second", and the like, are also used to describe various elements, regions, sections, etc. and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicate otherwise.

The present invention may be carried out in other specific ways than those herein set forth without departing from the scope and essential characteristics of the invention. In one embodiment, the gears 64 are positioned within the indentation 56 in the body 20. The present embodiments are, therefore, to be considered in all respects as illustrative and not restrictive, and all changes coming within the meaning and equivalency range of the appended claims are intended to be embraced therein.

What is claimed is:

1. A toner cartridge for use with an image forming device comprising:

a body with an outer wall that forms an enclosed reservoir to contain toner and an outlet to move the toner from the reservoir, the outer wall having an indentation;

a plurality of shafts each including an elongated section and an end, the shafts being operatively connected to the body and positioned with the elongated sections extending within the reservoir and the ends extending through at least one opening in the outer wall of the body;

a plurality of gears each being attached to the ends of the plurality of shafts that extend through the at least one opening in the outer wall of the body; and a bearing plate positioned in the indentation of the outer wall of the body and intermediate the outer wall and the plurality of gears the bearing plate having a plurality of apertures that each receive one of the plurality of shaft ends, the apertures sized to contact the shafts to locate the plurality of gears relative to the body and to form a bearing surface during rotation of the plurality of shafts.

2. The cartridge of claim 1, wherein one of the plurality of shafts is an agitating member that includes a paddle that extends outward from the shaft and is positioned within the reservoir with rotation of the agitating member causing the paddle to agitate the toner within the reservoir.

3. The cartridge of claim 1, wherein the at least one opening further includes a seal about the plurality of shaft ends to prevent toner from escaping out of the reservoir.

4. The cartridge of claim 1, wherein the body further includes an extension that extends outward from the outer wall and fits within an opening in the bearing plate to position the bearing plate relative to the body.

5. The toner cartridge of claim 1 wherein the at least one opening comprises a plurality of openings, one of the plurality of openings positioned about each end of the plurality of shafts extending through the wall of the body.

6. A toner cartridge for use with an image forming device comprising:

a body with an outer wall that forms an enclosed interior reservoir to contain toner, the body further including first and second apertures that extend through an indentation in the outer wall and into the reservoir, a bearing plate positioned in the indentation of the outer wall of the body adjacent to the reservoir and intermediate the outer wall and the plurality of gears, the bearing plate including a first bearing plate aperture that aligns with the first opening and a second bearing plate aperture that aligns with the second opening;

a first rotational member positioned within the reservoir and extending through the first aperture and the first bearing plate aperture to an exterior of the reservoir, the first rotational member contacting against the bearing plate and located within the first aperture and spaced away from the outer wall; and a second rotational member positioned within the reservoir and extending through the second aperture and the second bearing plate aperture to the exterior of the reservoir, the second rotational member contacting against the bearing plate and located within the second aperture and spaced away from the outer wall.

7. The cartridge of claim 6, wherein the indention and the bearing plate have substantially the same shape to prevent the bearing plate from moving relative to the body.

8. The cartridge of claim 6, wherein one of the first and second rotational members is an agitating member that includes paddles positioned within the reservoir to agitate the toner.

9. The cartridge of claim 6, wherein the body is constructed of a first material and the bearing plate is constructed of a different second material.

10. A toner cartridge for use with an image forming device comprising:

a body with an outer wall that forms an enclosed reservoir to contain toner and an outlet to move the toner from the reservoir;

an indentation formed within the outer wall of the body and including a sidewall and a bottom side, the bottom side including a first body aperture and a second body aperture;

a bearing plate constructed of a different material than the body and positioned within the indentation, the bearing plate including a first bearing plate aperture that aligns with the first body aperture and a second bearing plate aperture that aligns with the second body aperture;

a first rotational member with a first elongated section that extends from the reservoir and through the first body aperture and the first bearing plate aperture to an exterior of the reservoir, the first rotational member contacting against the bearing plate to be located within the first body aperture and be spaced away from the outer wall;

a first gear attached to an end of the first rotational member that extends from the reservoir;

a second rotational member with a second elongated section that extends from the reservoir and through the second body aperture and the second bearing plate aperture to an exterior of the reservoir, the second rotational member contacting against the bearing plate to be located within the second body aperture and be spaced away from the outer wall; and a second gear attached to an end of the second rotational member that extends from the reservoir, the second gear being operatively connected to the first gear.

11. The cartridge of claim 10, wherein the bearing plate is thinner than the outer wall.

12. The cartridge of claim 10, wherein the first and second gears are positioned within the indentation within the outer wall.

13. The cartridge of claim 10, further comprising an extension that extends outward from the bottom side of the indentation and the bearing plate includes a third bearing plate aperture, the extension positioned within the third bearing plate aperture when the bearing plate is positioned within the indentation.

14. The cartridge of claim 10, wherein the first rotational member further includes a paddle positioned within the reservoir to agitate the toner during rotation of the first rotational member.

15. The cartridge of claim 10, further including a drive gear operatively connected to the first and second gears to provide rotational power to rotate the first and second gears.

16. The cartridge of claim 15, wherein the drive gear is positioned on an opposing side of the body from the first and second gears.

17. The cartridge of claim 10, further comprising an auger positioned within the reservoir to move the toner towards the outlet, the auger including an auger shaft that extends through the outer wall of the body and through an additional bearing plate aperture, the auger shaft contacting the bearing plate to locate the auger relative to the first and second rotational members.

18. The cartridge of claim 10, wherein the bearing plate is positioned on an opposing side of the body from the outlet.

19. The cartridge of claim 10, wherein the first rotational member includes a second end that extends through a second side of the reservoir.

* * * * *